United States Patent [19]

Hester

[11] Patent Number: 5,009,373

[45] Date of Patent: Apr. 23, 1991

[54] DEVICE AND METHOD FOR DETECTING AND DISPLAYING CROSSOVER PATTERN IN PRECISION WINDING

[75] Inventor: Troy I. Hester, Huntsville, Ala.

[73] Assignee: The United States of America as represented by the Secretary of the Army, Washington, D.C.

[21] Appl. No.: 509,112

[22] Filed: Apr. 16, 1990

[51] Int. Cl.[5] ..... B65H 54/28; B65H 54/00

[52] U.S. Cl. ..... 242/158 R; 242/18 R; 242/18 G; 242/25 R; 242/47

[58] Field of Search ..... 242/158 R, 158 B, 158.1, 242/158.2, 158.3, 158.4 R, 158.4 A, 158.5, 54 R, 25 R, 18 R, 18 G, 47

[56] References Cited

U.S. PATENT DOCUMENTS

| | | | |
|---|---|---|---|
| 4,410,147 | 10/1983 | Seibert | 242/158 R |
| 4,456,199 | 6/1984 | Seibert | 242/158 R |
| 4,655,410 | 4/1987 | Ruffin et al. | 242/158 R |
| 4,838,500 | 6/1989 | Graham | 242/158 R |
| 4,920,738 | 5/1990 | White et al. | 242/158 R |
| 4,928,904 | 5/1990 | Watts | 242/158 R |
| 4,953,804 | 9/1990 | Hester | 242/158 R |

*Primary Examiner*—Stanley N. Gilreath

*Attorney, Agent, or Firm*—Freddie M. Bush; Hay Kyung Chang

[57] ABSTRACT

In precision winding of fibers onto a bobbin mounted on a mandrel, a suitably positioned circuit of lag angle detector, differentiator, threshold and status latch detect the occurrence of a crossover event while a suitably positioned circuit of angle counter, turn counter and data latch record the absolute mandrel angle and the number of complete revolutions of the mandrel at each occurrence of the crossover event. A computer coupled to the status latch and data latch graphically depicts the absolute mandrel angle versus the number of revolutions at the time of each crossover occurrence. This graphic depiction simulates the crossover pattern, thus making it possible to observe the pattern without stopping the winding process to inspect the pattern visually.

6 Claims, 3 Drawing Sheets

DEVICE AND METHOD FOR DETECTING AND DISPLAYING CROSSOVER PATTERN IN PRECISION WINDING

DEDICATORY CLAUSE

The invention described herein may be manufactured, used, and licensed by or for the Government for governmental purposes without the payment to me of any royalties thereon.

BACKGROUND OF THE INVENTION

In precision winding of fiber, such as optical fiber or natural or synthetic fabric thread, the fiber is wound layer by layer over a tapered cylindrical bobbin. All odd layers are wound in one direction (example: from left to right) and all even layers are wound in the opposite direction (i.e. from right to left). Since the fiber layers are wound on top of the layer directly below, the winding fiber tends to fall within the grooves 2 formed by two adjacent turns of fiber 4 in the layer directly below, as shown in FIG. 1. Further, each present layer 12, after the very first layer, begins and ends a stepback distance 10 away from the outermost winds 8A and 8B of the preceding layer 14. The stepback distance serves to prevent the slipping of wound material off of the edges of the bobbin 6 during activities such as handling. However, because the present layer 12 is being wound in a direction opposite that of the preceding layer 14, the fiber encounters itself at some point in making a complete turn around the circumference of the bobbin. Experience in precision winding of fiber indicates that the fiber generally does not jump over itself at this point but that it crosses over some underlying turns of the fiber and settles back into another groove. The regions where this occurs in a wind are called "crossovers". Usually, crossovers occur in the vicinity of one another on a given layer and form crossover patterns as illustrated in FIG. 1. They are readily detectable by visual inspection and provide a qualitative measure of overall winding quality. Under current technology, it is necessary to stop the winding process and visually inspect the winding to see these crossover patterns.

SUMMARY OF THE INVENTION

The device and method for detecting and displaying crossover pattern in precision winding makes it possible to observe crossover patterns without stopping the winding process. A lag angle detector (LAD) is used to detect crossover occurring during a winding process. In conjunction with a suitable circuit built of a differentiator, threshold, angle counter, turn counter, status latch and data latch, the information from LAD can be used to display crossover patterns graphically on a computer monitor and enable observation of the patterns without stopping the winding process. The crossover pattern information can be stored in the computer and retrieved at a later time for underlying layers where visual inspection after completion of winding is impossible.

DESCRIPTION OF THE PREFERRED EMBODIMENT

Figure 1:
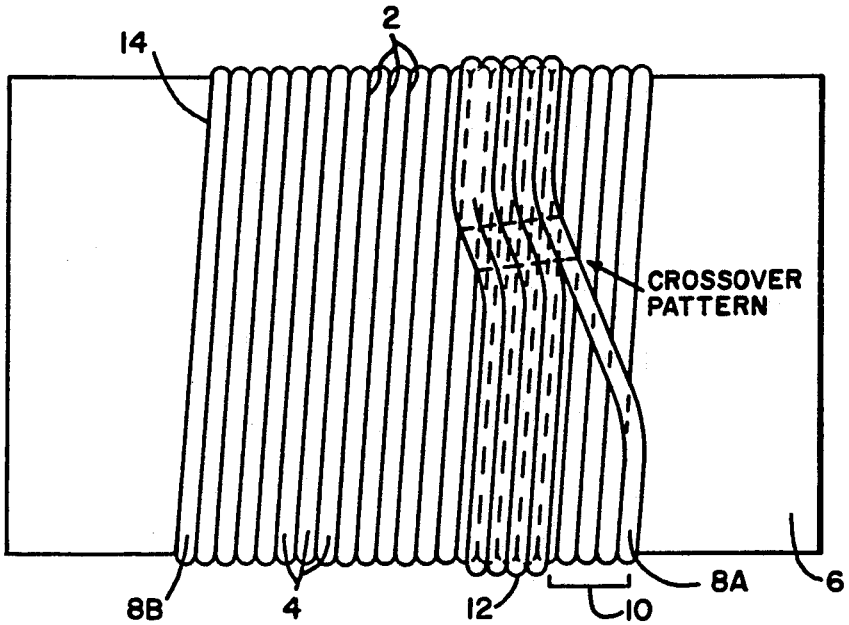
FIG. 1 is a side view of a bobbin on which fiber is wound.

Referring now to the drawings wherein like numbers refer to like parts, FIG. 1 is explained in the Background.

Figure 2:
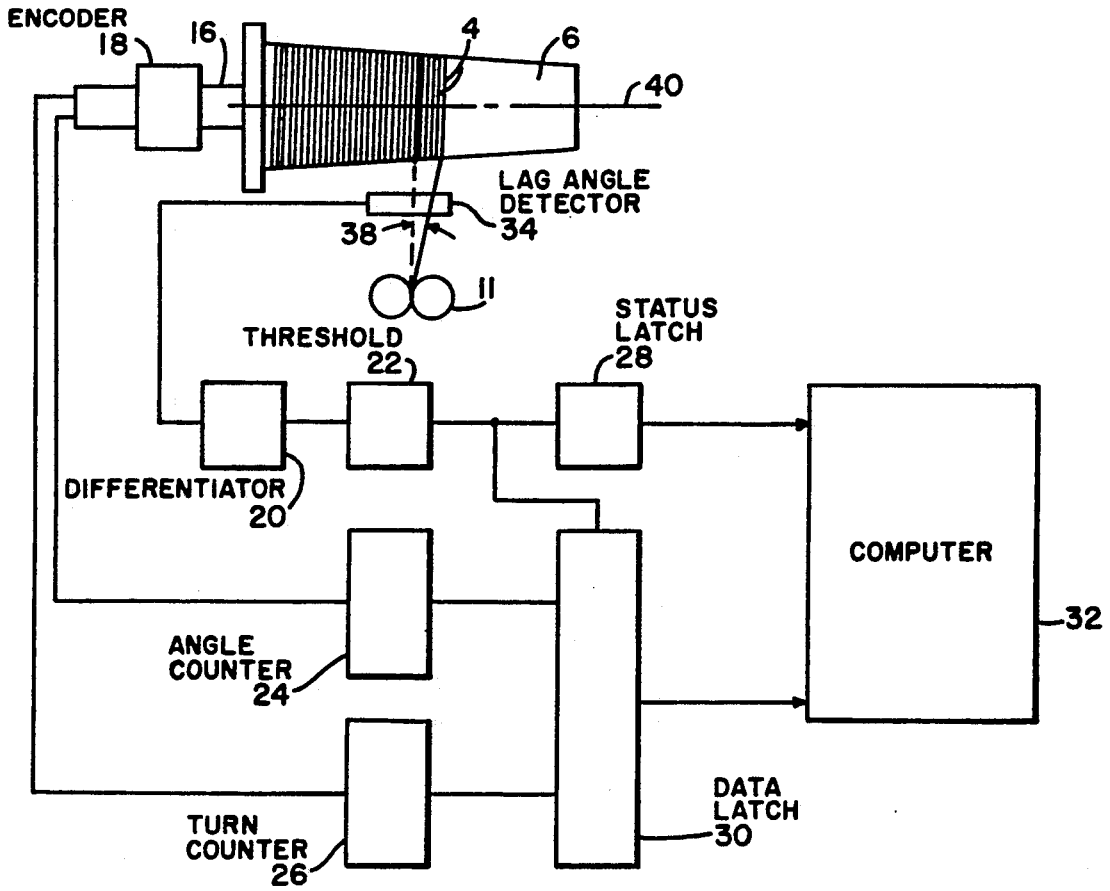
FIG. 2 is a schematic illustration of a preferred embodiment of the device and method for detecting and displaying crossover pattern in precision winding.
Figure 3A:
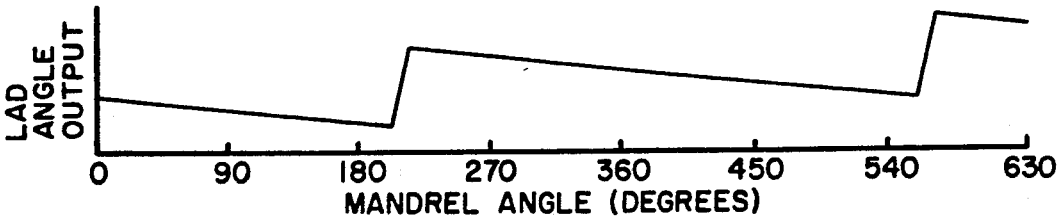
FIG. 3A is a graphic illustration of a typical lag angle detector angle output signal.
Figure 3B:
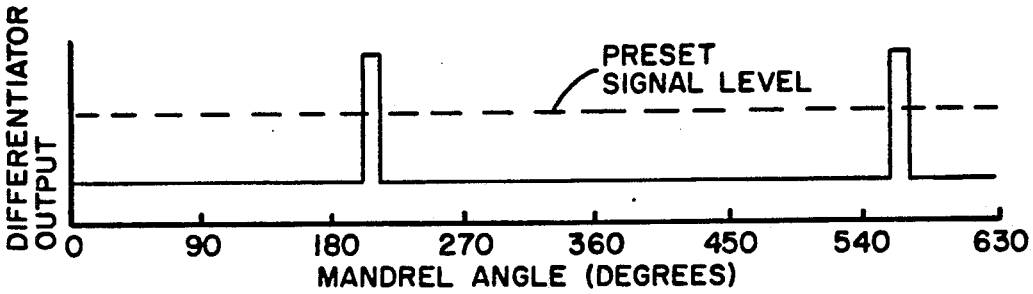
FIG. 3B is a graphic illustration of differentiator output.
Figure 3C:
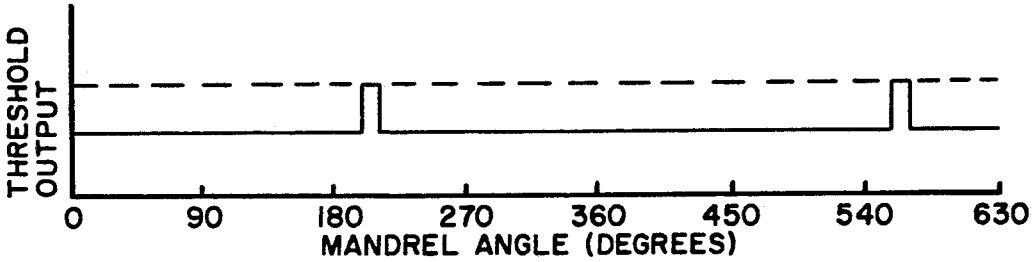
FIG. 3C is a graphic illustration of a threshold output.
Figure 4:
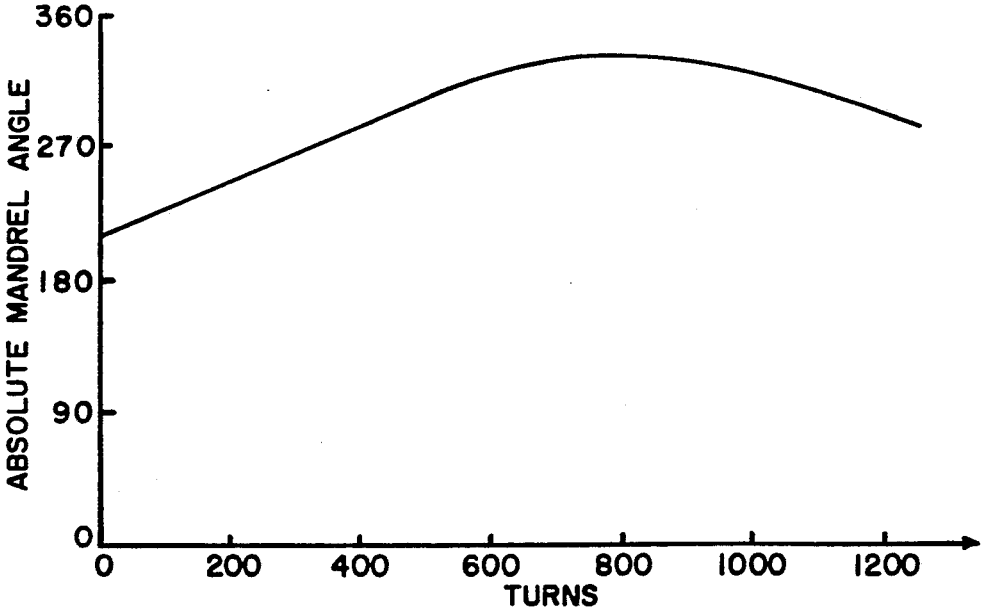
FIG. 4 is an example of a graph of absolute mandrel angle versus the number of complete revolutions of the mandrel.

Turning now to FIG. 2, bobbin 6 is mounted on a rotatable and transversible mandrel 16. Fiber 4 is wound from spool 11 onto bobbin 6 as the bobbin is spun around its axis 40 by mandrel 16. As fiber 4 is wound, its lag angle 38 is measured by lag angle detector (LAD) 34. This angle indicates the position of the fiber along axis 40 of bobbin 6 at any time during the winding process. A typical lag angle signal from LAD is shown in FIG. 3A. As the winding progresses, the lag angle changes gradually in the direction opposite the winding direction until the fiber encounters itself, at which point, the lag angle changes abruptly in the direction of the wind as the fiber 4 is dislodged from its groove and crosses some turns of the preceding layer before settling into another groove. At what point in a complete revolution of the bobbin, the initial abrupt lag angle change occurs is insignificant. However, the second and subsequent abrupt changes generally occur at 360° intervals. The lag angle signals from LAD are then input to a differentiator 20 which looks for abrupt changes in the signals and outputs differentiated signals which are depicted in FIG. 3B. The points where the signals exceed the preset signal level indicates occurrences of crossover events. The differentiator output is then input to threshold 22 which alerts the status latch whenever a crossover event is detected, indicated by the rectangular rises in FIG. 3C. Status latch 28 records the occurrences and in turn alerts a host computer 32 of the events. As mandrel 16 rotates, encoder 18 measures the rotation angles of mandrel 16 and outputs incremental digital signals which are proportional to the rotation angles. This incremental digital signals are input to angle counter 24 and to turn counter 26. Angle counter 24 accumulates the signals from encoder 18 and outputs digital representations of the absolute mandrel angles which are then input to data latch 30. Turn counter 26 measures the numbers of complete revolutions of mandrel 16 and inputs this information to data latch 30. The crossover event occurrences detected by threshold 22 are also input to data latch 30. This is to enable the host computer to obtain information regarding the crossover event from data latch after a time lapse from the moment the computer is alerted by status latch of a crossover occurrence. This allows the computer to complete whatever task it may be engaged in when the status latch alerts it of a crossover event. When computer 32, working with a suitable program, is alerted by status latch 28 of a crossover event, then the computer obtains from data latch 30 the absolute mandrel angle and the number of complete revolutions of mandrel 16 at the time of the crossover occurrence. Computer continues this activity and displays the results in a graphic depiction of the mandrel angle versus the number of the complete revolutions at each detected crossover occurrence. Such a graphic display is shown in FIG. 4 and is a facsimile of the actual crossover pattern on bobbin 6. The following components may be used for status latch, data latch, angle counter and turn counter.

| | |
|---|---|
| status latch | 7474 TTL dual D flip-flop |
| data latch | 4 of 74374 TTL 8 bit register |
| angle counter | 4 of 74193 TTL 4 bit binary counter |
| turn counter | 4 of 74193 TTL 4 bit binary counter |

Figure 5:
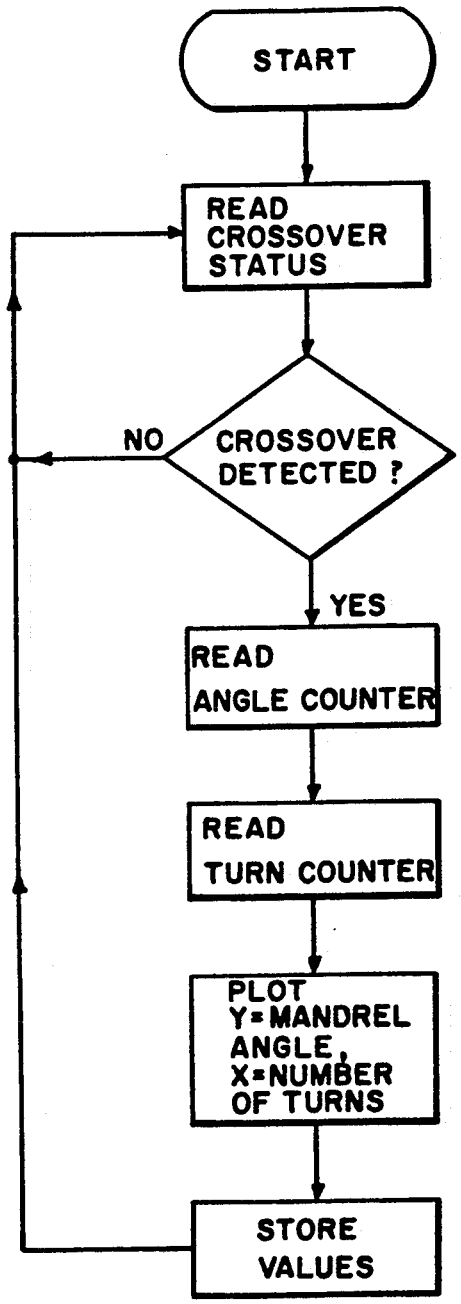
FIG. 5 is a flow chart describing the basic operation of the host computer shown in FIG. 2.

A flow chart in FIG. 5 summarizes the activities of the circuit shown in FIG. 2 as follows: After the device or the method for detecting and displaying crossover patterns in precision winding is initiated, computer 32 polls status latch 28 for any occurrence of a crossover event. If no occurrence is detected, then the computer continues to monitor the status latch until a crossover event is detected. When a crossover event is detected, then the computer obtains from angle counter 24 via data latch the absolute mandrel angle at the time of the crossover event and obtains from turn counter 26 via data latch the number of complete revolution of the mandrel at the time of the crossover event. This process is repeated for each crossover event detected. The computer, then graphically displays absolute mandrel angle versus the number of complete turns of the mandrel at each occurrence of a crossover event and enables observation of the crossover patterns without stopping the winding process. Such information may be stored for later retrieval.

Although a particular embodiment and form of this invention has been illustrated, it is apparent that various modifications and embodiments of the invention may be made by those skilled in the art without departing from the scope and spirit of the foregoing disclosure. Accordingly, the scope of the invention should be limited only by the claims appended hereto.

I claim:

1. In a system for winding fiber onto a bobbin, wherein the bobbin is mounted for rotation on a mandrel and a fiber, to be wound, is coupled to said bobbin, a device for detecting and displaying crossover patterns during the winding, comprising: a crossover occurrence detection means suitably positioned to monitor the lag angle of the winding fiber and provide an output signal when a predetermined threshold of lag angle is detected, thereby indicating a crossover occurrence, an encoder coupled to said mandrel to measure the rotation angle of said mandrel and provide output signals proportional to the rotation angles, counting means coupled to receive output signals from said encoder and provide an output absolute mandrel angle and output number of complete revolutions of the mandrel at any time, and displaying means suitably positioned to receive output from said detection means and counting means and display the output.

2. A device as set forth in claim 1, wherein said detection means comprises a lag angle detector suitably positioned to detect and provide lag angle output of the fiber; a differentiator, a threshold and a status latch coupled in series, said differentiator being further coupled to receive output from said lag angle detector and said status latch being further coupled to provide output signals to said displaying means.

3. A device as set forth in claim 2, wherein said counting means comprises a data latch, an angle counter and a turn counter, said counters being coupled between said encoder and said data latch in parallel and said data latch is further coupled to said displaying means.

4. A device as set forth in claim 3, wherein said signal outputs from said encoder and said counting means are digital.

5. A device for detecting and displaying crossover patterns formed by fiber during a precision winding thereof, comprising: a bobbin having an axial hole therein, a rotatable mandrel inserted into said hole, an encoder coupled to said mandrel to measure the rotation angle and the number of revolutions of said mandrel, a lag angle detector suitably positioned to detect the lag angle of the fiber being wound onto said bobbin and output the lag angle as electrical signals, a differentiator coupled to receive the electrical signals from said lag angle detector and output differentiated signals, a threshold coupled to receive the differentiated signals from said differentiator and output crossover event signals, a status latch coupled to said threshold to receive output from said threshold and store the output, an angle counter coupled to said encoder to record the rotation angle of said mandrel and output said angle, a turn counter, said turn counter coupled to said encoder to record the number of revolutions of said mandrel and output said number, a data latch coupled to said angle counter, to said turn counter and to said status latch to receive output therefrom, and provide output, a displaying means coupled to said data latch to receive output therefrom and display said output.

6. A method for detecting and displaying crossover patterns during precision winding, comprising the steps of:

detecting lag angles of the fiber being wound onto a bobbin, converting the lag angles into electrical signals, differentiating said signals, passing the differentiated signals through a threshold to detect crossover events, storing the crossover events in a data latch, measuring the rotation angles of the mandrel on which the bobbin is mounted, counting the number of complete turns of the mandrel, sensing the rotation angle and the number of revolutions of the mandrel at the time of each occurrence of a crossover event, and displaying the mandrel angle relative to the number of revolutions at each occurrence of a crossover event.

* * * * *